US006777875B1

(12) United States Patent
Steinman et al.

(10) Patent No.: US 6,777,875 B1
(45) Date of Patent: Aug. 17, 2004

(54) ELECTRIC LAMP

(75) Inventors: Maarten Walter Steinman, Eindhoven (NL); Mathias Leonardus Maria Tunissen, Nederweert (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 76 days.

(21) Appl. No.: 09/856,768

(22) PCT Filed: Sep. 26, 2000

(86) PCT No.: PCT/EP00/09483

§ 371 (c)(1),
(2), (4) Date: May 24, 2001

(87) PCT Pub. No.: WO01/26129

PCT Pub. Date: Apr. 12, 2001

(30) Foreign Application Priority Data

Oct. 1, 1999 (EP) ..... 99203224

(51) Int. Cl.[7] ..... H01J 5/46; H01K 1/40

(52) U.S. Cl. ..... 313/623; 313/626; 313/355

(58) Field of Search ..... 313/318, 623, 313/331, 332, 315, 222, 626, 345, 355; 361/305, 304, 303, 314, 315; 428/418, 419, 698, 627, 694 NF

(56) References Cited

U.S. PATENT DOCUMENTS 4,015,165 A * 3/1977 Hardies ..... 313/318
4,173,518 A * 11/1979 Yamada et al. ..... 204/67
4,501,799 A * 2/1985 Driessen et al. ..... 428/446
6,594,134 B2 * 7/2003 Yializis ..... 361/305

FOREIGN PATENT DOCUMENTS

EP 0573114 A1 12/1993 ..... G01K/1/40

* cited by examiner

*Primary Examiner*—Ashok Patel
(74) *Attorney, Agent, or Firm*—Ernestine C. Bartlett

(57) ABSTRACT

The electric lamp (1) has a lamp vessel (2), wherein an electric element (3) is accommodated. Said element is connected to current conductors (4), molybdenum end portions (5) of which extend outside the lamp vessel and have a skin of titanium nitride or chromium carbide as a protection against oxidation.

2 Claims, 1 Drawing Sheet

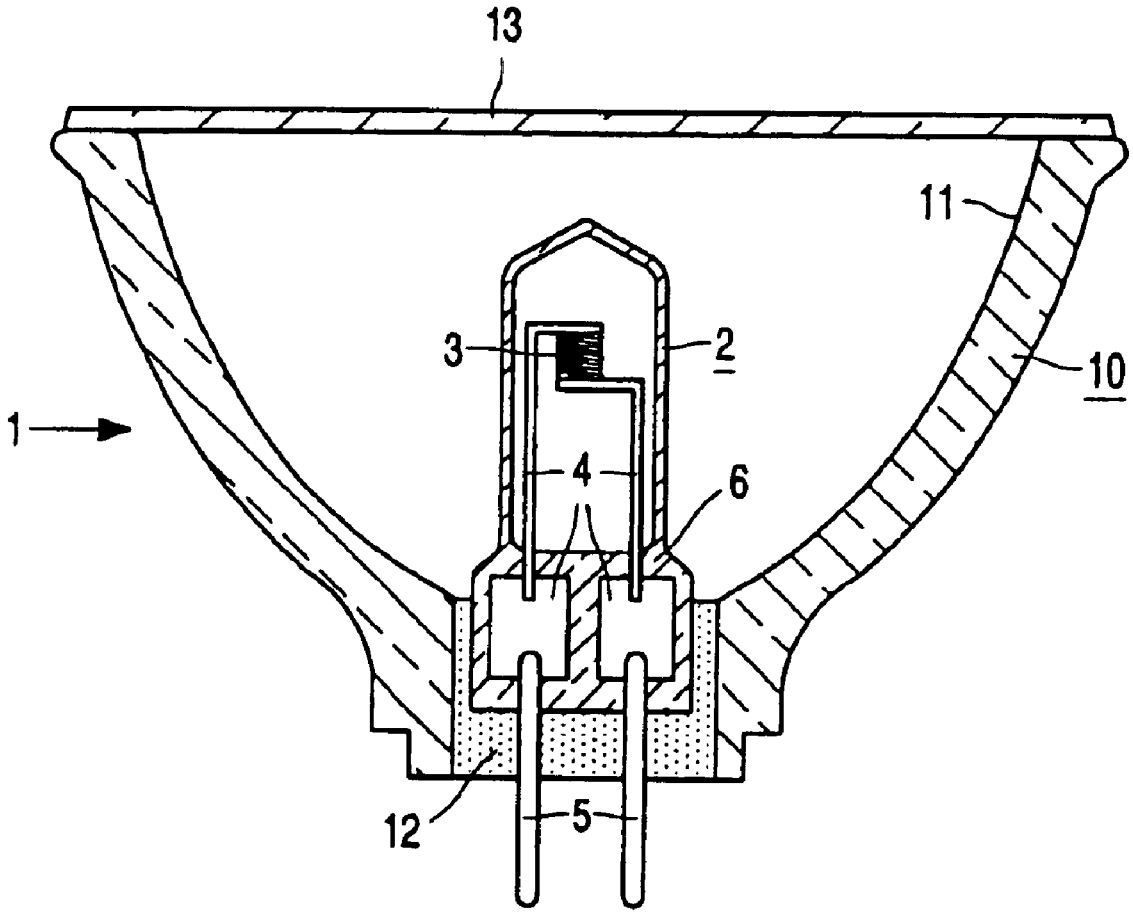
13
11
3
2
10
1
4
6
12
5

ELECTRIC LAMP

BACKGROUND OF THE INVENTION

The invention relates to an electric lamp comprising a glass lamp vessel which is closed in a gastight manner and in which an electric element is accommodated, current conductors connected to the electric element which each have an end portion of molybdenum projecting to outside the lamp vessel, said end portion being provided with means for protection against oxidation.

Such an electric lamp is known from EP 573 114.

Current conductors with molybdenum end portions are often used in electric lamps because this metal is resistant to high temperatures and because this metal has a coefficient of expansion which matches that of hard glasses well and deviates only little from that of quartz glass, i.e. glass with an $SiO_2$ content of at least 95% by weight.

It is a disadvantage of molybdenum, however, that it readily oxidates at room temperature already, so that there is a considerable risk that a good electrical contact with, for example, the connection terminals of a lampholder will be lost.

According to the cited patent document, the end portions are provided with a molybdenum nitride coating. A disadvantage of the known lamp is, however, that an oxidation resistance up to no more than a comparatively low temperature, i.e. approximately 200° C., is obtained. Furthermore, the coating has the additional disadvantage that the end portions become more liable to fracture.

OBJECTS AND SUMMARY OF THE INVENTION

It is an object of the invention to provide an electric lamp of the kind described in the opening paragraph in which the above disadvantages are counteracted.

According to the invention, this object is achieved in that the electric lamp of the kind described in the opening paragraph is characterized in that the end portion has a skin which is chosen from a group of materials formed by titanium nitride and chromium carbide.

The titanium nitride or chromium carbide skin is not only easy to realize, but it is also an effective agent against oxidation not only at room temperature but also at elevated temperatures, for example up to approximately 400° C. Titanium nitride and chromium carbide, moreover, have the advantages that they do not lead to an increased brittleness of the molybdenum end portion and that they are thermally stable also at very high temperatures, for example 2000° C. That is to say that titanium nitride and chromium carbide substantially do not form compounds or alloys with molybdenum which melt at lower temperatures than those used in the manufacture of the lamp. The thermal stability at very high temperatures also implies that no dissociation of the compounds occurs owing to the high temperature, leading to compounds which are unsuitable for the oxidation-resistant coating. This renders said compounds suitable for use as a skin on metal parts which is effective against oxidation, for example in lamps, for example quartz glass lamps, for which very high temperatures are used in the lamp manufacturing process.

Preferably, the skin has a layer thickness of at least 2 $\mu$m and at most 3 $\mu$m. A layer thickness below 2 $\mu$m provides the molybdenum with an insufficient protection against oxidation. A layer thickness above 3 $\mu$m is unnecessarily expensive because it does not provide any better protection against oxidation than a skin with a layer thickness of 3 $\mu$m.

The oxidation-resistant skin on the molybdenum end portion may be readily obtained in a vapor deposition process, for example a CVD process. The CVD process has the advantage that many molybdenum end portions can be vaporized simultaneously in one and the same process. A molybdenum end portion provided with an oxidation-resistant skin can thus be manufactured comparatively inexpensively.

In spite of the protection against oxidation provided by the titanium nitride or chromium carbide skin, the protected end portion can be processed in a conventional manner, for example by welding to a metal foil, for example to a molybdenum foil on which a gastight seal of the lamp vessel is realized. A good electrical connection, which is only a few m$\Omega$ larger than in the case of platinum or platinum-plated end portions, can be realized on the protected end portion, for example by means of contacts of a lampholder.

The electric element of the lamp may be a pair of electrodes in an ionizable gas or an incandescent body, for example in an inert gas comprising halogen. The lamp vessel may have one or several seals from which a current conductor issues to the exterior. The lamp vessel, for example made of quartz glass or hard glass, may be joined together with a reflector body so as to form a lamp.

BRIEF DESCRIPTION OF THE DRAWING

An embodiment of the electric lamp according to the invention is shown in longitudinal sectional view in the drawing.

DESCRIPTION OF THE PREFERRED EMBODIMENTS

In the FIGURE, the electric lamp 1 has a glass lamp vessel 2 which is closed in a gastight manner and in which an electric element 3, an incandescent body in the FIGURE, is accommodated, and a reflector body 10 which has a mirroring surface 11 and a closing plate 13. The lamp vessel 2 is secured in the reflector body 10 by means of cement 12. Current conductors 4 having molybdenum end portions 5 projecting to outside the lamp vessel 2 are connected to the electric element 3. The end portion 5 has means for protection against oxidation. The end portion 5 for this purpose has a skin of chromium carbide. The skin has a layer thickness of approximately 2.5 $\mu$m.

In the FIGURE, the current conductors 4 comprise legs of the incandescent body 3 and molybdenum foils connected thereto by means of welds. End portions 5 provided with chromium carbide skins are also welded to the foils and serve as contact pins for the lamp.

Experiments with this lamp 1, which has a rated power of 100 W and a lamp voltage of 12 V, have demonstrated that the lamp 1 has a useful life which is twice that of a known lamp, and a useful life equal to that of a lamp having end portions 5 provided with a platinum coating.

The lamp shown may be used, for example, for accent lighting, for projection purposes, or for photo, video, or film recording sessions.

What is claimed is:

1. An electric lamp comprising a glass lamp vessel which is closed in a gastight manner and in which an electric element is accommodated, current conductors connected to the electric element which each have an end portion of molybdenum projecting to outside the lamp vessel, said end portion being provided with means for protection against oxidation, characterized in that the end portion has a skin which is chosen from a group of materials formed by titanium nitride and chromium carbide.

2. An electric lamp as claimed in claim 1, characterized in that the skin has a layer thickness of at least 2 $\mu$m and at most 3 $\mu$m.

* * * * *